United States Patent [19]

Ciucani

[11] 4,289,083

[45] Sep. 15, 1981

[54] AUTOMATIC MACHINE FOR ZIG-ZAG STITCHING OF TUBULAR ELEMENTS

[76] Inventor: Mario Ciucani, Via dell'Universita, 16-Fermo, Italy

[21] Appl. No.: 97,705

[22] Filed: Nov. 27, 1979

[30] Foreign Application Priority Data

Nov. 30, 1978 [IT] Italy ..... 3608 A/78

[51] Int. Cl.[3] ..... D05B 3/04

[52] U.S. Cl. ..... 112/157; 112/60; 112/62

[58] Field of Search ..... 112/157, 28, 47, 60, 112/62, 121.12, 121.15

[56] References Cited

U.S. PATENT DOCUMENTS 3,126,853 3/1964 Maves ..... 112/62 X
3,776,158 12/1973 Zechini ..... 112/47 X
3,779,185 12/1973 Sakakura et al. ..... 112/121.12

*Primary Examiner*—Peter P. Nerbun
*Attorney, Agent, or Firm*—Fleit & Jacobson

[57] ABSTRACT

An automatic machine for zig-zag stitching of tubular elements, in particular for stitching trimmings on mocassin type footwear and for fixing transversal reinforcing bands to the vamp of the footwear, where the cylinder containing the "crochet" is circular-sectioned and the work plane on which to lay the material to be stitched is curved with its curve center on the axis of the cylinder and the work plane is supported by a collar co-axial with and external to the cylinder, and longitudinally mobile and rotarily coaxial with respect to said cylinder. The machine also includes the pressure foot which grips the material to be stitched tautly to said work plane, the pressure foot being supported by a guide line fixed to said collar and arranged above the work plane.

8 Claims, 5 Drawing Figures

AUTOMATIC MACHINE FOR ZIG-ZAG STITCHING OF TUBULAR ELEMENTS

The present invention refers to an automatic machine for zig-zag stitching of tubular elements, in particular to stitching trimmings on mocassin type footwear and fixing transversal reinforcing bands to the vamp of said footwear.

As is known in the field of hide and leather machining, in particular the shoe industry, it is sometimes necessary to stitch decorative trimmings on the material being machined, or add accessories to the material being machined, with stitching which, far from being purely decorative, has a notable mechanical resistance.

This problem is particularly noted in the shoe industry, where it is often necessary to stitch for example boot legs or the seam connecting the vamp to the transveral reinforcing bands on mocassin type footwear in interesting small or large zig-zag designs.

As also known, the type of footwear or shoe commonly known as "mocassin", as presently manufactured industrially, is normally in soft unlined leather with flexible sole, unlaced, and is composed of an open or closed vamp connected to a small flap, forming the upper closing of the shoe, through different stitching techniques.

To reinforce the shoe flap top, which is subject to considerable stress while walking due to pressure from the instep, the shoe is equipped with a transversal band which overlaps said flap top, its side ends being connected to the upper edges of the vamp near said flap.

Today this transversal band is machine stitched to open vamp footwear and hard stitched to closed vamp footwear, where, once the vamp has been stitched to the flap, it is thereafter impossible to enter the shoe with known mechanical means.

This stitching is generally zig-zag, and, if it is done by mechanical means, the machines which are used have a cammed programmer which controls all device movements that are necessary to retain and guide the parts to be stitched under the sewing machine needle.

The known machines suitable for the abovementioned type of stitching are, as above mentioned, used to stitch open vamps, or, at any rate, slowly developing pieces of material. The known machines generally have a support below the needle supporting head, commonly known as the cylinder, in which the "crochet" is situated. The cylinder of the invention has a flat surface which forms a work plane on which to lay the material to be stitched. Said work plane is associated with movement devices, which, in suitable times, cause its alternate transversal linear movement to the cylinder and alternate linear and/or axially intermittent movement to the same cylinder. Also associated to this work plane is a device which blocks the material to be stitched on the work plane, the device being comprised of a pressure foot to grip the material, and being operated in contrast with said work plane and arranged in correspondence to the needle guide. The pressure foot is normally shaped in such a way that it has two parallel prongs between which the needle must operate, and it is designed to keep the material being stitched taut and close to the work plane.

During the stitching phase, the blocking device follows the movements of the work plane so that the material gripped is moved, in phase with the movements of the needle, below the needle itself to obtain the zig-zag effect which is desired.

The known machines described above are widely applied when stitching flat surfaces, in particular open vamps, but are not suitable for stitching tubular elements, especially mocassin type footwear with closed vamps. In fact, if the work plane and connected pressure foot and associated pressure foot are linearly moved, transversally to the cylinder, and especially if these movements are fairly extensive, the material must be moved eccentrically to the cylinder axis, which is only possible when the circumference of the vamp and connected flap is so much greater than the cylinder's circumference that the work plane and associated pressure foot may be linearly moved with the vamp or flap gripped between them.

In opposite cases, i.e. when the shoe is tightly wound round the cylinder, these movements are not possible and it is thus necessary to revert to hand stitching.

The purpose of the present invention is to overcome the above-mentioned drawbacks, and, in particular, to supply an automatic machine suitable for zig-zag stitching of tubular elements, particularly for stitching the trimmings of mocassin type footwear and for fixing the transversal reinforcing band to the vamp of same; the machine being constructed in such a way that even very large decorative designs may be zig-zag stitched on tubular elements, independent of any clearance existing between the tubular element being stitched (e.g. as already mentioned, a boot leg or closed vamp mocassin shoe) and the cylinder from which the work plane and pressure foot (which grip and move the material under the needle) are moved.

Another purpose of this invention is to supply a machine with the above-mentioned type of structure, extremely simple and therefore cheap to produce and safe to operate.

These purposes are fulfilled by the machine invented, of the type comprising a base support with protruding head to support the needle and relevant movement devices, below which the machine cylinder housing the "crochet" is located and with respect to which cylinder having a work plane on which to lay the material to be stitched and a pressure foot operating in contrast with said work plane to grip the material and move it under the needle in phase with its movements, both are mobile; and where said movements are controlled by one cam or more, splined to a shaft rotated by the machine's means of motorization and affecting operating devices inserted in the feed circuit and control of the movement devices of said work plane and pressure foot, characterized by the fact that said cylinder is circular-sectioned and that said work plane is curved with its curve centre on the axis of the same cylinder, said work plane being supported by a collar coaxial to the cylinder and longitudinally mobile and coaxially rotary to it, and by the fact that said pressure foot is supported by guide lines fixed to said collar and arranged above the work plane and runs smoothly with respect to them in radial direction to the cylinder. It is important to note that, due to the fact the work plane and pressure foot which can be rotated around the cylinder axis even when a very large zig-zag design is desired and also where the tubular element being stitched fits the work plane and cylinder without any clearance, there is no eccentric movement of the material with respect to the latter and it is therefore possible to move all the material under the needle as required.

These and further features of the machine invented will now be more fully illustrated by the description which follows of a preferred, but not exclusive, type of construction, illustrated in the attached designs in which.

Figure 1:
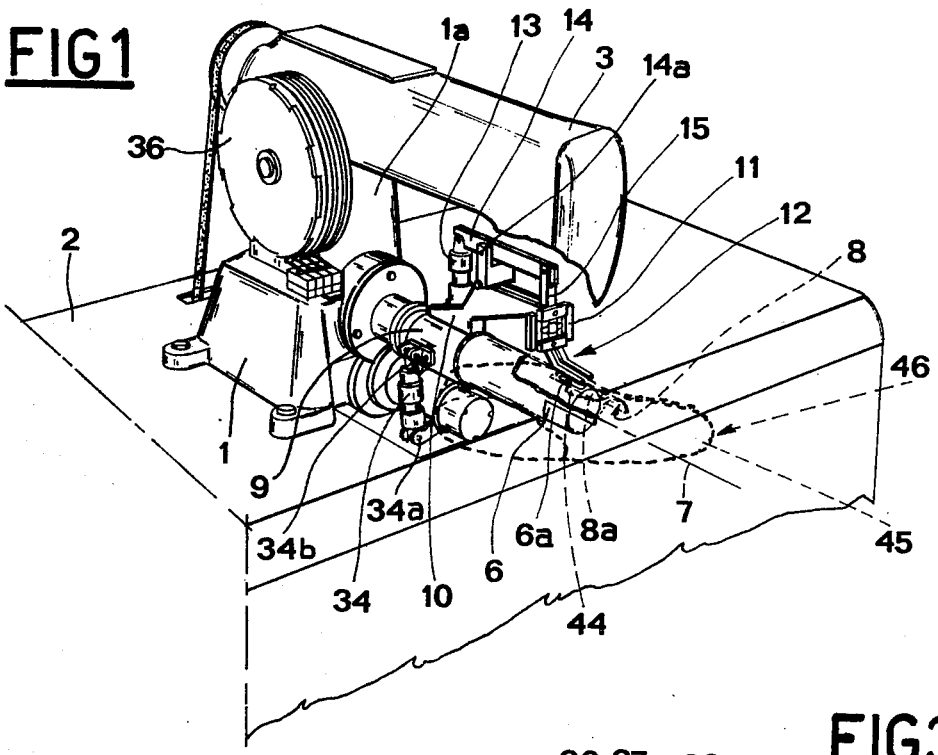
FIG. 1 shows a perspective view of the above-mentioned machine.
Figure 2:
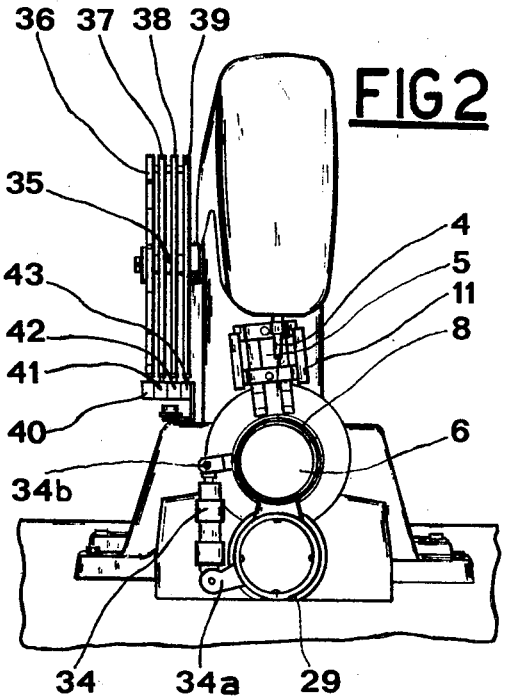
FIG. 2 is a diagram of the above-mentioned machine viewed from the front, in a first working position.
Figure 3:
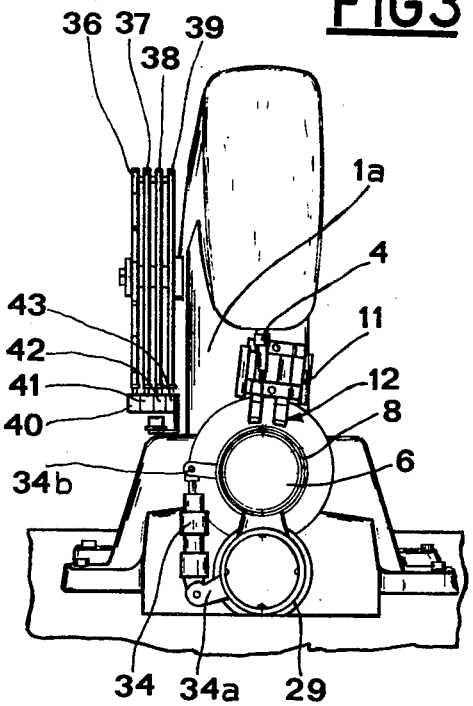
FIG. 3 is a diagram of the abovementioned machine viewed from the front, in a second working position.

With reference to the above-described figures, and in particular to FIG. 1, FIG. 2 and FIG. 3, the abovementioned machine is mainly composed of a base support 1 fixed to a work bench 2 in which work bench the engine and machine control members are located. The engine and machine control members are of known type and are neither described nor illustrated in the present drawings. The conformation of base support 1 presents a protruding or projecting head 3 in which the supporting and needle movement device 4 and thread puller 5 are located. These devices are also of known type and are neither illustrated in the drawings nor described in detail.

The needle 4 is supported to move alternatively in a vertical plane normal to that supporting work bench 2. The number 6 indicates the complete element commonly known to technicians in this sector as the machine cylinder. Cylinder 6 is fixed to the vertical turret 1*a* of base support 1 and is horizontally located so that it projects below the projecting head 3 so that its axis 7 intersects the guide line of needle 4. The "crochet" is located in cylinder 6, together with relative movement members.

As is known, the "crochet" is the element which works with the needle to form stitches. The "crochet", not illustrated in the drawings is located at the free end of cylinder 6. Further, at the free end, cylinder 6 has a slit through which needle 4 passes during the sewing operation.

In accordance with the idea for solution proposed in this invention, cylinder 6 is circular-sectioned and is overlapped by a curved work plane with curve center on the axis of cylinder 6, the work plane being carried by a collar 9 coaxial to the same cylinder 6, with the possibility of sliding either rotatively or axially relative to the latter.

The purpose of work plane 8, as will be seen more fully later, is to support the material to be stitched and to move it under needle 4. Work plane 8 has a slit 8*a* through which needle 4 passes during stitching in any of the positions it may adopt in connection with the way it is moved to obtain a desired stitching design.

The number 10 indicates a supporting bracket integral to collar 9, extending above cylinder 6, a guide 11 being fixed to its free end. Guide 11 is arranged on a vertical plane normal to axis 7 of cylinder 6 and the machine pressure foot 12 runs smoothly inside it.

As already illustrated in the introductory part of the description, the pressure foot is the element which cooperates with the work plane in drawing the material being stitched under the needle.

Pressure foot 12 is subject to the action of a small pneumatic piston 13 which makes it possible to bring it to a first position near work plane 8 and to a second position in which it is distant from same.

The lower part of the cylinder of small pneumatic piston 13 is articulated to supporting bracket 10, while its stem is connected to one of the ends of a lever 14, the lever 14 being balance-articulated in 14*a* to supporting bracket 10. The other end of lever 14 is connected to the body of pressure foot 12 by means of small connecting rod 15.

The action of small pneumatic piston 13 is operator-controlled by a pedal which may be pushed at the start and finish of the stitching cycle.

A description will now be given of the movement devices controlling collar 9 and therefore work plane 8 and pressure foot 12.

Figure 4:
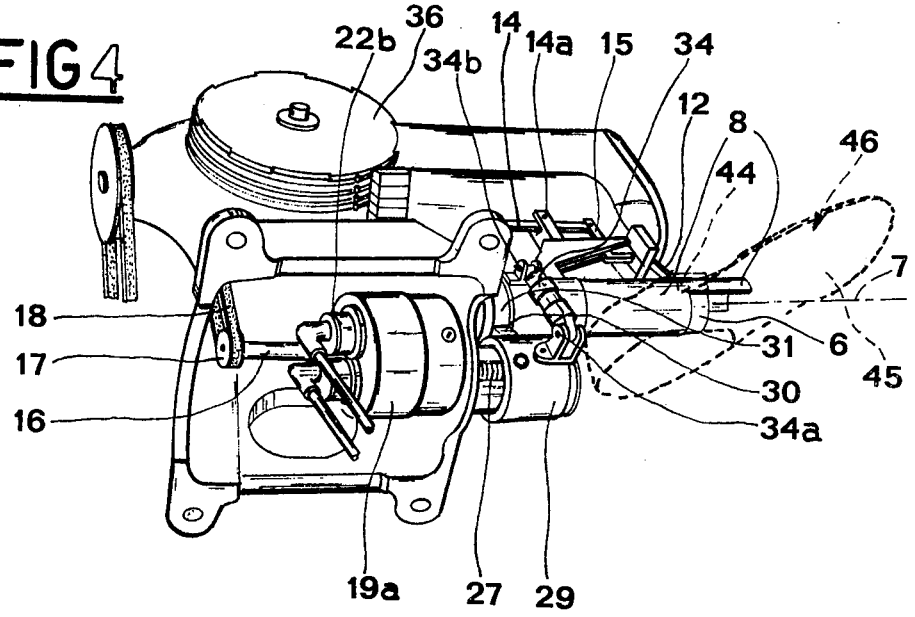
FIG. 4 is a diagram of the above-mentioned machine in a perspective view from below, revealing only part of the devices controlling the movements of the work plane with respect to the cylinder.
Figure 5:
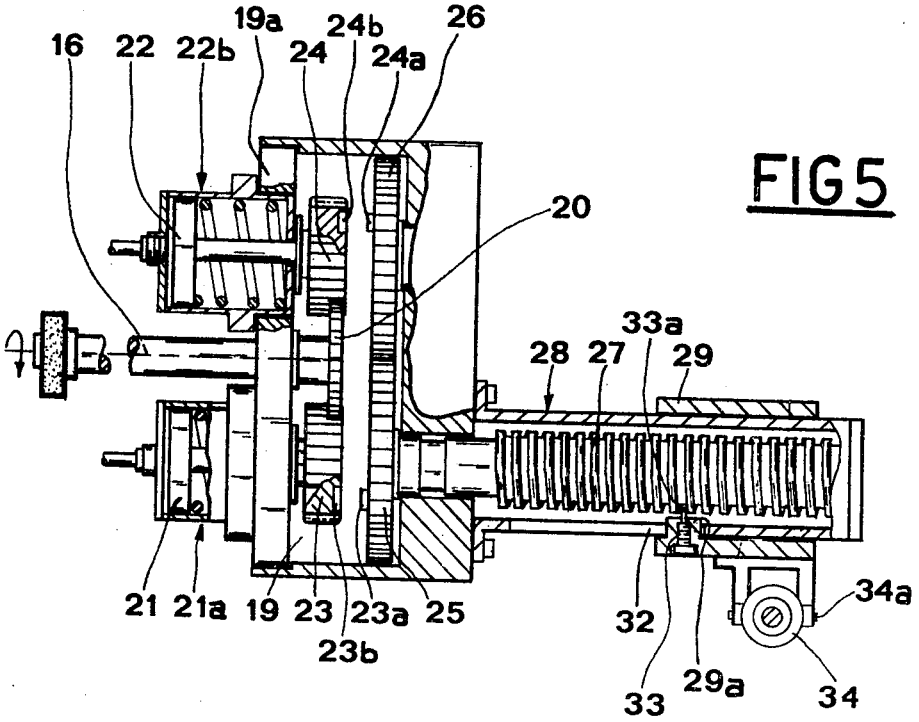
FIG. 5 shows schematically and in overhead view plant a detail of the devices shown in FIG. 4, i.e. the screw controlling the axial movement of the work plane and of the pressure foot in relation to the cylinder and the relevant means which start them rotating.

With particular reference to FIGS. 4 and 5, a description follows of the devices which permit work plane 8 and pressure foot 12 to run smoothly in relation to cylinder 6.

The number 16 indicates a shaft motorized through a kinematic connection, comprising a pulley 17 and a driving belt 18, by the machine's general motorization unit. Shaft 16 is fitted with one-way rotary movement and is supported by a flange 19*a* connected to a hollow cylindrical support 19 fixed inside base support 1 positioned on a level lower than cylinder 6, with its axis parallel to the axis of said cylinder 6.

Shaft 16 extends inside hollow cylindrical support 19 and leads serrated pinion 20 splined to the end inside said support. More will be said about this pinion later.

The numbers 21*a* and 22*b* indicate the cylinders of two small pneumatically controlled pistons 21 and 22 supported by flange 19*a* arranged with their axes parallel to each other and parallel to the axis of shaft 16. On the stems of these small pistons 21 and 22, which extend inside the hollow cylindrical support 19, two serrated pinions 23 and 24 are splined, free to rotate, engaged with serrated pinion 20 carried by shaft 16. Serrated pinions 23 and 24 are so thick that they keep serrated pinion 20 engaged even when, as will be seen later, they are subject to the action of small pneumatic pistons 21 and 22 which are made slide toward it.

The numbers 25 and 26 indicate two further serrated pinions arranged inside hollow cylindrical support 19 and supported by same.

The serrated pinions 25 and 26 engage each other and are coaxial to and face the serrated pinions 23 and 24. The distance between the pinions which face each other is shorter than that of the traverse of pneumatically controlled small piston plungers 21 and 22.

The serrated pinion 25 is directly connected to a screw 27 whose threads, according to what is already known, for half the transversal section of the screw present their axis parallel on a plane normal to the axis of the screw itself and for the other half, present their axis sloping to form a constant angle with said plane.

Screw 27 is contained in and supported by a hollow cylinder 28 which extends below cylinder 6 and is parallel to it. A collar 29 slides along hollow cylinder 28 with an open protrusion 30 which fits into a circumferential spline 31 obtained on collar 9. Rotation of collar 29 with respect to hollow cylinder 28 is impeded by a protrusion 29*a* inside the same collar 29, sliding smoothly into a longitudinal slit 32 on the side surface of hollow cylinder 28.

The number 33 indicates a threaded pin which passes inside protrusion 29*a* and its end 33*a* fits between the threads of screw 27.

Consequently, as the rotation of collar 29 is blocked, if screw 27 is rotated either in one direction or in the opposite direction, collar 29 will make corresponding axial movements in intermittent steps with respect to hollow cylinder 28 (because of the pin connection with the screw). Since protrusion 30 is engaged within circumferential groove 31 of collar 9, the rotation of screw 27 will cause collar 9 to move back and forth in intermittent steps which in turn will move the work plane 8 and pressure foot 12 back and forth with respect to cylinder 6.

The rotational movement of screw 27 derives from shaft 16 as described below.

As mentioned, serrated pinion 20 carried by shaft 16 is engaged by pinions 23 and 24 and serrated pinions 25 and 26 are engaged to each other and coaxial to serrated pinions 23 and 24. The surfaces which face each other of the pinions 23 and 25 and the surfaces which face each other of the pinions 24 and 26 have at least one protrusion 23*a* or 24*a* and at least one notch 23*b* or 24*b* within which the protrusions can be inserted to produce a restrained rotative coupling between the pinions 23 and 25 and between the pinions 24 and 26. This coupling takes place when, due to the action of small pneumatic pistons 21 and 22, either of the serrated pinions 23 or 24 is pushed, in suitable times at any rate, against the serrated pinion which it faces, 25 or 26 respectively.

Observing FIG. 5, it should be noted that, if the small pneumatic piston 21 is put into operation, there is frontal coupling between serrated pinion 23 and serrated pinion 25 and therefore, if we consider that shaft 16 rotates in right-hand direction, screw 27 rotates in opposite direction to the previous one, i.e. in the left-hand direction, while alone serrated pinion 24 rotates freely.

Operation of small pneumatic pistons 21 and 22 is controlled by corresponding cams which will be described later.

Having described the devices which make it possible to make work plane 8 and pressure foot 12 slide axially at intermittent steps to cylinder 6, a description is now given for the devices which, in the case illustrated in the drawing, permit them to rotate alternately around the same cylinder 6. In accordance with what has been illustrated in the drawing, said devices are very simply comprised of a small double-acting pneumatically controlled piston 34 with cylinder articulated in 34*a* to collar 29 where the stem of the relevant plunger is articulated in 34*b* to collar 9.

Due to the fact that it is impossible for collar 29 to rotate around hollow cylinder 28, as the stem of small pneumatic piston 34 emerges from and then re-enters the relevant cylinder, there will be alternate rotation of collar 9 and therefore of work plane 8 and of pressure foot 12 around cylinder 6. Operation of small pneumatic piston 34 is also controlled by a corresponding cam. The cams which permit action of the small pneumatic pistons 21, 22 and 34, in suitable times and in relation to the stitching design desired, are splined to a single shaft 35, see FIGS. 1, 2 and 3, revolvingly supported by base support 1 and started rotating by the general motorization devices of the machine itself.

In the case illustrated, cam 36 operates small pneumatic piston 21, cam 37 operates small pneumatic piston 22 and cam 38 operates small pneumatic piston 34. A further cam 39 is also foreseen to determine the start and finish of a complete sewing cycle.

The cams (36-37-38) operate corresponding microswitches (40-41-42) inserted in the electrical feed circuit of the same number of solenoid valves in turn inserted in the pneumatic circuit operating the small pistons (21-22-34), while cam 39 operates a microswitch 43 inserted in the electrical feed circuit of the general motorization means of the machine. Said valves and circuits are of known type and are not described here.

From what has been illustrated above, it is also easy to guess how the machine in question functions.

At the start of the machining cycle, the stems of the small pneumatic pistons 13-21-22 and 34 are in the reentry position, the pressure foot 12 is in the raised position and the needle 4 in the maximum traverse position, in upward direction. The operator may therefore easily position the material to be stitched, for example referring to FIGS. 1 and 4, band 44 and closed vamp 45 of mocassin type shoe 46, on work plane 8 by inserting the tubular element in same work plane 8, obviously on cylinder 6. Subsequently, by operating a special control (which, as already mentioned, could be a pedal placed at the start and finish of the sewing cycle), the operator sets the small pneumatic piston 13 in movement and lowers pressure foot 12 which thus, in contrast with work plane 8, grips the material being stitched.

The pushbutton which starts machine motorization (not illustrated) is then pressed, starting movement of needle 4, thread puller 5 and the machine "crochet" and shaft 16 which rotates screw 27 and shaft 35 on which the cams (36-37-38-39) are splined.

Depending on the shaping of the track of cams 36-37-38 and therefore of their effect on microswitches 40-41-42, the small pneumatic pistons 21-22-34 will function in suitable times for work plane 8 and pressure foot 12 to slide intermittently to cylinder 6, and, in phase with this sliding movement, their alternate rotation to the same cylinder 6 to reach the positions illustrated, e.g. in FIGS. 2 and 3, to achieve the zig-zag sewing design programmed.

At the end of a programmed sewing cycle, cam 39, which operates microswitch 43, opens the feed circuit of the general machine motorization means and stops all its operative devices, restoring them to their initial condition.

Obviously, the invention is not restricted to the shapes described and illustrated, e.g. to achieve alternate rotation of work plane 8 and pressure foot 12 around cylinder 6, a device identical to that illustrated may be used to make them slide back and forth from said cylinder, as the shape of pressure foot 12 may vary with the sewing design required and the cams (36-37-38-39) may also be replaced with other equivalent devices without therefore departing from the protective ambit of the invention, or, at any rate, from what is claimed below.

It is claimed:

1. An automatic machine for zig-zag stitching of tubular elements, which machine is capable of stitching trimmings on mocassin type footwear and of fixing transversal reinforcing bands to the vamp of said footwear, said machine comprising a base support with a projecting head to support a needle and a machine cylinder which is positioned below the projecting head in which cylinder a "crochet" is located, with respect to which cylinder a work plane on which to lay the material to be machined and a pressure foot are mobile, wherein the pressure foot operates in contrast with said work plane to grip the material and move it under the needle in phase with the needle's movement; and where movements of said work plane and said pressure foot are controlled by one or more cams splined on a shaft rotated by the machine's motorization means, which cams activate operative devices inserted in the machine's feed circuit to operate the machine and which operative devices control movement devices which cause movement of said work plane and pressure foot; characterized by the fact that said cylinder is circular-sectioned and that said work plane is curved with its curve center being on the axis of the cylinder itself, said work plane being supported by a collar coaxial to the cylinder and longitudinally mobile with respect to the cylinder and rotatively coaxial with the cylinder, and that said pressure foot is supported by a guide line fixed to said collar and arranged above the work plane and extends smoothly with respect to said collar and said work plane in a radial direction from the cylinder.

2. An automatic machine for zig-zag stitching of tubular elements, which machine is capable of zig-zag stitching trimmings on mocassin-type footwear and capable of fixing transversal reinforcing bands to the vamp of said footwear, said machine comprising:

a base support with a projecting head to support a needle;

a machine cylinder positioned beneath the projecting head, and having a crochet located within, which crochet is capable of coacting with said needle to form stitches in the material being operated on by said machine;

a work plane on which to lay said material being operated on and a pressure foot, both of which are moveable relative to said cylinder; where the pressure foot operates in conjunction with said work plane to grip said material and move said material under said needle in phase with the movement of said needle;

means for moving said work plane and said pressure foot relative to said cylinder;

one or more cam means splined on a shaft which is rotated by the machine's motorization means, wherein said one or more cam means are means for controlling the means for moving said work plane and said pressure foot relative to said cylinder.

3. The machine of claim 2 wherein said cylinder is circular-sectioned and said work plane is curved, with its center of curvature being along the axis of the cylinder;

where said work plane is supported by a collar which is coaxial with the cylinder and which is longitudinally mobile and rotatively coaxial with the cylinder;

and where the pressure foot is supported by a guide line which is fixed to said collar and arranged above the work plane and extends smoothly with respect to said collar and said work plane in a radial direction from and along the cylinder.

4. The machine of claim 3 including means for moving the pressure foot relative to said work plane to grip the material.

5. The machine of claim 4 wherein the means for controlling the means for moving said work plane and said pressure foot includes a cam means for determining the start and finish of a sewing cycle, and controlling the feed circuit of the machine accordingly.

6. Automatic machine, according to claim 1 or claim 3 in which the work plane is moved longitudinally relative to the cylinder with movements at intermittent steps being in phase with the needle movement, with the longitudinal movement of the work plane being effected via a screw, of which the axis threads are, for half the traversal section of the screw, on a plane normal to the screw axis and, for the other half, the threads develop helicoidally with an axis sloping to form a constant angle with said plane; characterized by the fact that said screw is moved kinematically; and a shaft is connected to the machine's motorization means, equipped with one-way rotational movement, with the shaft leading a serrated pinion splined to one end of the shaft, this pinion being engaged with a first pair of serrated pinions, each pinion of said first pair being rotatably supported by the stem of a relevant small pneumatically controlled piston arranged with its axis parallel to the axis of said shaft; a second pair of serrated pinions, the first pair of pinions being spaced from the second pair at a distance less than that of the piston stroke of said small pneumatic pistons, with each of the serrated pinions of said second pair being coaxial to the serrated pinion in the first pair facing it and the two pairs of serrated pinions being equipped with protrusions or recesses which are capable of being paired and mated when coupling of the facing pinions commences with corresponding recesses or protrusions in the facing pinions, said screw being coaxial with and directly connected to one of the pinions in said second pair.

7. Machine according to claim 6, characterized by the fact that said screw is supported inside a hollow cylinder located below the machine cylinder and parallel to it, and by the fact that said work plane is linked to the screw by a second collar coaxial with the hollow cylinder containing the screw and said work plane slides in a direction axial to the screw, said second collar having an internal protrusion, which passes through a longitudinal slit in said hollow cylinder, said protrusion being equipped with a threaded hole in which a pin is engaged, the end of which pin extends within the hollow cylinder where it is engaged by the threads of said screw, and an external protrusion which extends from said second collar until it slides into a circumferential groove in the collar supporting the work plane.

8. Machine according to claim 7, characterized by the fact that, to obtain alternate rotation of the work plane around the cylinder of the machine in phase with an intermittent step movement of the same work plane axially to said cylinder, a small dual-effect piston is provided with a cylinder articulated to the second collar coaxial to the hollow cylinder supporting the screw, from which said work plane shunts said movement axially to the machine cylinder, and the stem of the piston is articulated to the collar supporting said work plane.

* * * * *